United States Patent [19]

Suh

[11] 4,279,843

[45] Jul. 21, 1981

[54] PROCESS FOR MAKING UNIFORM SIZE PARTICLES

[75] Inventor: Nam P. Suh, Sudbury, Mass.

[73] Assignee: Massachusetts Institute of Technology, Cambridge, Mass.

[21] Appl. No.: 134,181

[22] Filed: Mar. 26, 1980

Related U.S. Application Data

[63] Continuation-in-part of Ser. No. 78,320, Sep. 24, 1979, abandoned.

[51] Int. Cl.[3] ..... B01J 2/06

[52] U.S. Cl. ..... 264/11; 264/299

[58] Field of Search ..... 264/11, 299

[56] References Cited

U.S. PATENT DOCUMENTS 3,970,445 7/1976 Gale et al. ..... 264/11

4,124,377 11/1978 Larson ..... 264/11

*Primary Examiner*—Donald E. Czaja

*Assistant Examiner*—James R. Hall

*Attorney, Agent, or Firm*—Arthur A. Smith, Jr.; Paul J. Cook

[57] ABSTRACT

Uniform sized particles of a ceramic or metal composition are formed by impinging a liquid stream of the composition upon at least one liquid stream of a second ceramic or metal which has a lower melting point than that of the particles. The impingement causes the liquid precursor to the particles to form small eddies which become solidified through heat loss to the other liquid stream. The temperature of the mixture is maintained so that the particles remain solidified while the other liquid stream(s) remain liquid. The solid particles then are separated from the liquid.

7 Claims, 2 Drawing Figures

PROCESS FOR MAKING UNIFORM SIZE PARTICLES

REFERENCE TO RELATED APPLICATION

This application is a continuation-in-part of application Ser. No. 78,320, filed Sept. 24, 1979, now abandoned.

BACKGROUND OF THE INVENTION

At the present time, grinding of workpieces is conducted with grinding wheels having a grinding surface formed of a particulate abrasive material bonded by or embedded in a matrix such as organic resins, vitreous materials and metals. The abrasive particulates have a generally uniform size so that uniform grinding to form smooth surfaces can be attained for a given metal across the entire surface that contacts the grinding wheel. In addition, it is desirable that such smooth surfaces can be formed with surface removal rate sufficiently high so as to render the grinding process commercially attractive. For each grinding application there is an appropriate abrasive grit size which is optimum for the intended purpose. For example, in removing slag from cast steel, the preferred abrasive particle size is 1 mm, while finer abrasive particles of approximately 40 to 120 mesh are used in finish grinding of the surfaces.

Abrasive particles now are made by crushing a large billet produced from molten abrasive material. The billet is fractured and the particles having a size within the desired range then are separated such as by sieving. This procedure obviously is undesirable since a large portion of the crushed billet does not have the proper particle size and must either be reprocessed or discarded. Other applications for uniform size metal or metal alloy particles include obtaining uniform size metal powders that can be utilized to form articles by conventional powder metallurgy techniques.

It would be highly desirable to provide a method for forming uniform size particles of an abrasive material. Furthermore, it would be desirable to provide such a method which is applicable to metal, metal alloys or ceramics. In addition, it would be desirable to provide such a method wherein there is little or no waste material produced outside the desired particle size range.

SUMMARY OF THE INVENTION

The present invention provides for a method of obtaining uniform metal, metal alloy or ceramic particles. These particles are obtained by causing two or more liquid metal and/or ceramic streams to impinge upon each other under pressure so as to create a mixture under turbulent flow having small eddies. The temperatures and flow rates of the impinging streams are maintained so that, after impingement, the eddies formed from at least one of the streams freeze before they coalesce to a substantial degree while at least one of the streams remains in the liquid state. That is, it is desirable to effect cooling of at least one of the impinging compositions so that the viscosity forces of the overall mixture overcome the surface tension forces thereby minimizing or preventing coalescence of the components. The particles thus formed then are removed from the liquid component such as by ladeling, decantation, floatation or the like. When freezing of more than one of the impinging compositions is effected, they are recovered as a mixture from the remaining liquid.

DESCRIPTION OF SPECIFIC EMBODIMENTS

Figure 1:
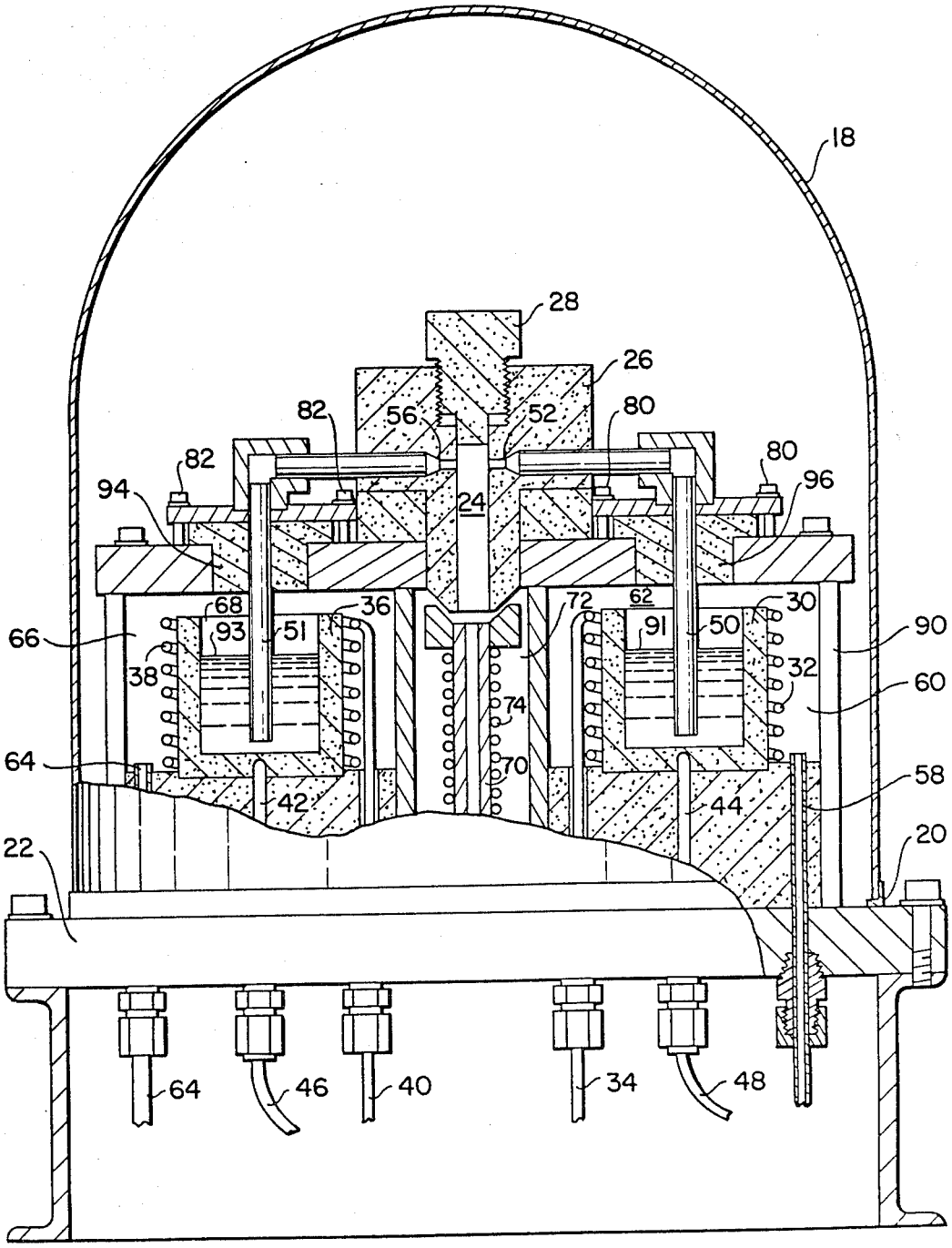
FIG. 1 is a cross-sectional view of an apparatus suitable to form the compositions of this invention.

The present invention provides metal or ceramic particles having substantially uniform size which are formed directly when two or more liquid compositions are intimately admixed to effect turbulent flow of the resultant mixture. Uniform size particles result due to the eddies formed during the turbulent flow which then are frozen quickly. The temperature and flow rates of the individual streams are controlled so that upon the formation of intermixed eddies the heat transfer between the eddies result in rapid nucleation of the solid phase formed from the liquid component that has the higher freezing temperature. It is necessary to freeze the composition having the higher melting point quickly after mixing is ended in order to prevent formation of large particles within the resultant composition by surface tension forces and/or by diffusion. Generally, the particles formed by the process of this invention have a size within the range of about 0.1 to 1000 microns, and more usually between about 1 and 100 microns. The liquids in each stream can either have the same or different viscosities as long as the velocity of each stream is such that the Reynolds Number associated with each stream exceeds a critical value which is about 50.

The compositions of this invention are formed by impinging at least two liquid streams upon each other so that turbulence is created. This is attained most preferably by moving the streams toward each other from opposite directions. The size of the eddies created during turbulence is proportional to the Reynolds number based on the diameter of the nozzle of the liquid stream resulting from the admixture of the individual streams in accordance with the relationship:

$$l \sim (Re)^{-\eta}$$

wherein l is the size of the average eddy, Re is the Reynolds number and $\eta$ is the factor generally within the range of about $\frac{1}{2}$ to about $\frac{3}{4}$. In accordance with the relationship given above, as the Reynolds number increases, the eddy size decreases. Accordingly, when smaller particle size, i.e., eddy size in the resultant mixture is desired, the Reynolds number of each individual stream should be increased accordingly so that the two or more streams impinge upon each other with substantial force thereby effecting an increased turbulence in the resultant mixture. Thereafter, it is desirable to effect freezing of at least one component liquid mixture as quickly as possible while maintaining at least one other component in the liquid state. Quick freezing is effected in order to maintain the small eddy size of the freezing component(s) caused by the initial stream impingement, thereby to minimize separation of the mixed liquids into their initial component parts caused by coalescence through surface tension forces of the component parts. Mixing of individual components can be effected simultaneously or sequentially. For example, two or more liquids can be made to impinge upon each other in an initial step followed as closely thereafter as possible by impingement with an additional liquid stream on the turbulent liquid stream resulting from the first mixing step. After the final liquid stream has been impinged upon the main turbulent stream and final particle formation is obtained for all but one of the final mixtures, the solid particles are separated from the liquid component such as by ladeling, decantation, floatation, filtration or the like. In operation, the temperature of the respective liquid streams and their flow rates are controlled to obtain the desired selective freezing. Generally, the temperature differential ($T_1-T_2$) between the stream which is to be solidified into particles and the stream which is to remain liquid is given by the expression $$(T_1 - T_2) = \frac{M_2C_2 + M_1C_1}{M_1C_1}(T_m - T_2) - \frac{M_1L_1}{M_1C_1}$$

where $T_1$ is the initial temperature of the material with a higher freezing point, $T_2$ is the initial temperature of the material with a lower freezing point, $M_1$ and $M_2$ is the mass of the material with higher and lower melting points, respectively, $T_m$ is the melting (or freezing) point of the material with a higher freezing temperature, $L_1$ is the latent heat of melting, and $C_1$ and $C_2$ are the heat capacity of the materials with the higher and lower melting points, respectively. This temperature should be large enough to prevent freezing of the higher melting material in transit from the reservoir to the mix chamber.

The compositions of this invention can be formed from any metal alloy or pure metal regardless of its chemical composition or from any ceramic composition so long as the composition can be changed to the liquid state upon heating thereof. Representative suitable alloys include lead alloys, iron alloys, nickel alloys or cobalt alloys. Examples of these alloys are lead-tin alloys, zinc-aluminum alloys, zinc-copper alloys, magnesium-aluminum alloys, magnesium-aluminum-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, super alloys and cobalt-chromium alloys or pure metals such as iron, copper, zinc, aluminum, nickel or magnesium or the like. Representative suitable ceramic compositions include nitrides, carbides, silicides, borides, oxides, carbonitrides or oxycarbides or alloys of oxides, carbides, oxycarbides, carbonitrides, nitrides, borides or silicides. Representative suitable abrasive materials include aluminum oxide, alumina-zirconia alloy, alumina-hafnia alloy, zirconium oxide or the like.

Figure 2:
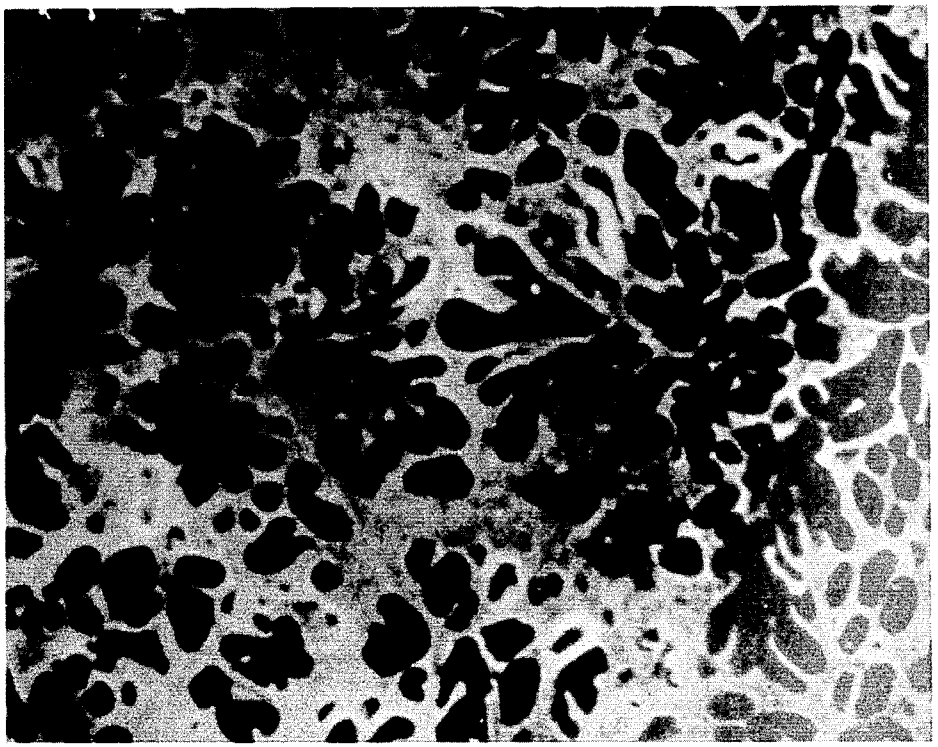
FIG. 2 is a picture taken with a scanning electron microscope showing aluminum particles formed by the process of this invention.

Referring to FIG. 1, the apparatus for forming the compositions shown in FIGS. 1 and 2 comprises a bell jar 18 which is sealed at the bottom by flange 20 positioned on base 22. A mixing chamber 24 is formed within graphite member 26 and comprises a hollow, generally cylindrical shape the length of which can be changed by movable adjustment member 28 also formed of graphite. A first liquid component is housed within graphite container 30 which is surrounded by heating coil 32 connected to a power supply 34. The second liquid component is housed within graphite container 36 surrounded by heating coil 38 which is connected to a power supply 40. Thermocouples 42 and 44 are connected respectively to power supplies 46 and 48 and partially embedded into the wall of containers 36 and 30 respectively to monitor the temperature within the containers. An L-shaped conduit 50 extends into container 30 and is connected to nozzle 52. L-shaped conduit 50 extends into container 30 and is connected to nozzle 52. L-shaped conduit 54 extends into container 36 and is connected to nozzle 56. The nozzles 52 and 56 communicate with chamber 24. Conduit 58 is connected to a gas supply (not shown) and extends into chamber 60 which includes a space 62 above container 30. Conduit 64 also is connected to a pressurized gas supply (not shown) and extends into chamber 66 having a section 68 positioned above container 36. A mold 70 is positioned within chamber 72 below chamber 24 and is surrounded by a cooling coil 74 which is connected to a refrigeration means (not shown).

The apparatus of FIG. 1 is utilized as follows: the bell jar 18 is removed and the bolts 80 and 82 are loosened in order to remove L-shaped conduits 50 and 54 as well as graphite holder 26 from the apparatus to expose containers 30 and 36. A first composition is placed in container 30 and a second composition is placed in container 36. The L-shaped conduits 50 and 54 are then replaced and the bolts 80 and 82 tightened in order to seal the chambers 60 and 66 from the atmosphere by means of wall 90 and plugs 96 and 94. Power then is provided to coils 32 and 28 in order to melt the compositions within chambers 30 and 32. The temperatures within chambers 30 and 36 are monitored by means of thermocouples 42 and 44 and, after the materials within the chambers are melted, gas is supplied to the chambers 60 and 66 through conduits 58 and 64 respectively in order to increase the pressure therein and specifically to increase the pressure in spaces 62 and 68 above the surfaces 91 and 93 of the molten liquid. It is desirable to effect this pressure rise as quickly as possible so that liquid flow through the L-shaped conduits 50 and 54 is effected at high pressure. The liquid emanating from nozzles 52 ad 56 impinge upon each other at high pressure within chamber 24 causing the desired mixing and resulting in a high Reynolds Number for the liquid mixture within chamber 24. The liquid mixture within chamber 24 falls by gravity into mold 70 and is cooled sufficiently quickly so that the eddies resulting from the desired turbulence of mixing are frozen within the solid product within the mold 70.

FIG. 2 is a micrograph at 375 times magnification of a product made by impinging 50 volume % tin at 400° C. with 50 volume % aluminum at 700° C. Impingement was made at 140 psi through ⅛ inch diameter nozzles into a chamber at 725° C. The resultant mixture was cooled immediately after mixing. The dark areas in the micrograph correspond to aluminum particles having a typical thickness of 7–8 microns.

I claim:

1. The process for forming solid particles from at least one selected from at least two liquid streams, each of said streams selected from the group consisting of a metal, a metal alloy and a ceramic which comprises impinging said liquid streams upon each other to form a turbulent mixture having small eddies, each of said liquid streams having a Reynolds number based on the nozzle diameter of at least about 50, regulating the temperature and flow rates of each of said streams to solidify at least one component of the turbulent mixture before substantial coalescence of the components of said streams while at least one component of said turbulent mixture remaining liquid and removing said solidified component as solid particles from the component which remains as a liquid.

2. The process of claim 1 wherein all of said streams are impinged upon each other simultaneously.

3. The process of claim 1 wherein at least three of said liquid streams are impinged upon each other sequentially.

4. The process of any one of claims 1 through 3 wherein all of said liquid streams comprises a metal or a metal alloy.

5. The process of any one of claims 1 through 3 wherein at least one of said liquid streams comprises a ceramic.

6. The process of any one of claims 1 through 3 wherein at least one of said liquid streams comprises a ceramic abrasive composition.

7. The process of any one of claims 1 through 3 wherein at least one of said liquid streams comprises a metal or metal alloy and at least one of said liquid streams comprises a ceramic composition.

* * * * *